US007407470B2

(12) United States Patent
Perini

(10) Patent No.: US 7,407,470 B2
(45) Date of Patent: Aug. 5, 2008

(54) APPARATUS FOR FEEDING PAPER WEBS AND THE LIKE, FOR THE PRODUCTION OF CARDBOARD TUBES

(76) Inventor: Fabio Perini, Via S. Francesco 1, I-55049, Viareggio (Lucca) (IT)

( * ) Notice: Subject to any disclaimer, the term of this patent is extended or adjusted under 35 U.S.C. 154(b) by 446 days.

(21) Appl. No.: 10/525,448

(22) PCT Filed: Jul. 25, 2003

(86) PCT No.: PCT/IT03/00459

§ 371 (c)(1),
(2), (4) Date: Feb. 22, 2005

(87) PCT Pub. No.: WO2004/028793

PCT Pub. Date: Apr. 8, 2004

(65) Prior Publication Data

US 2005/0245377 A1 Nov. 3, 2005

(30) Foreign Application Priority Data

Sep. 26, 2002 (IT) ..... FI2002A0181

(51) Int. Cl.
*B31C 1/00* (2006.01)

(52) U.S. Cl. ..... 493/269

(58) Field of Classification Search ..... 493/269, 493/276

See application file for complete search history.

(56) References Cited

U.S. PATENT DOCUMENTS

| | | | |
|---|---|---|---|
| 4,395,253 | A | 7/1983 | Goodman |
| 5,882,287 | A | 3/1999 | Kuckhermann |

FOREIGN PATENT DOCUMENTS

| | | |
|---|---|---|
| FR | 2 606 706 | 5/1988 |
| FR | 2 734 757 | 12/1996 |
| GB | 937918 | 9/1963 |
| WO | WO 95/10399 | 4/1995 |
| WO | WO 95/10400 | 4/1995 |

*Primary Examiner*—Peter M. Cuomo
*Assistant Examiner*—Sang Kim
(74) *Attorney, Agent, or Firm*—McGlew and Tuttle, P.C.

(57) ABSTRACT

Apparatus for feeding paper webs and the like, for producing cardboard tubes, characterized in that it comprises a plan modular structure (1) with a development mostly longitudinal and exhibiting two opposite surfaces (1*a*, 1*b*), one (1*a*) of the surfaces supporting pairs of shafts or axes (2, 2') horizontally oriented parallel to the one surface and located at a preset distance from the ground, each of the shafts or axes (2, 2') intended to support at least a reel (3, 3') from which a paper web unwinds, so that the output webs run parallel and superimposed to each other along the other surface (1*b*) of the structure, and in that it comprises automatic means, associated with the structure (1), for the cutting and mutual gluing of the webs which unwind from two different reels (3, 3') of a same pair of shafts (2, 2').

5 Claims, 10 Drawing Sheets

APPARATUS FOR FEEDING PAPER WEBS AND THE LIKE, FOR THE PRODUCTION OF CARDBOARD TUBES

CROSS REFERENCE TO RELATED APPLICATIONS

This application is a United States National Phase application of International Application PCT/IT2003/000459 and claims the benefit of priority under 35 U.S.C. § 119 of FI2002A000181 filed Sep. 26, 2002, the entire contents of which are incorporated herein by reference.

FIELD OF THE INVENTION

The present invention pertains to an apparatus for feeding paper webs and the like for the production of cardboard tubes.

BACKGROUND OF THE INVENTION

A technique commonly adopted for the production of cardboard tubes is one making use of tube-forming machines provided with a spindle on which there are wound—to form a series of spirals being superimposed and offset of a predetermined pitch—a plurality of webs of paper or similar material suitably glued in correspondence of a surface intended to result in facing relationship to the spindle. The gluing is not operated on the first web of the series, as it is intended to directly make contact with the spindle. The motion of the webs is ensured by a belt wound around the spindle which, in addition, causes the rotation and the advancement of the tube under formation with respect to the spindle's longitudinal axis.

A tube-forming machine so constructed and operating is described in WO 95/10400 and WO 95/10399.

The webs, being spirally superimposed and mutually glued to form the tube, unwind from corresponding feeding reels.

Each of the reels is mounted on a corresponding support associated with means for gluing the respective web. A plurality of supports, independent from each other, are mounted in such a way as to form in their entirety a kind of fan-like figure, so that each web is directed towards the spindle of the tube-forming machine according to a corresponding angle of incidence. In relation to this, the devices presently known for supplying webs to tube-forming machines are relatively bulky, take up excessive space and force the webs to run along cross routes and in different planes, thereby contributing to a poorly rational exploitation of the available spaces at the production site.

SUMMARY OF THE INVENTION

The main object of the present invention is to overcome the above drawbacks.

The present invention makes it possible to exploit the available spaces and reduce the overall cost of the plant. Besides, it allows making an auxiliary structure which facilitates the handling and fixing of the reels onto the respective support axes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
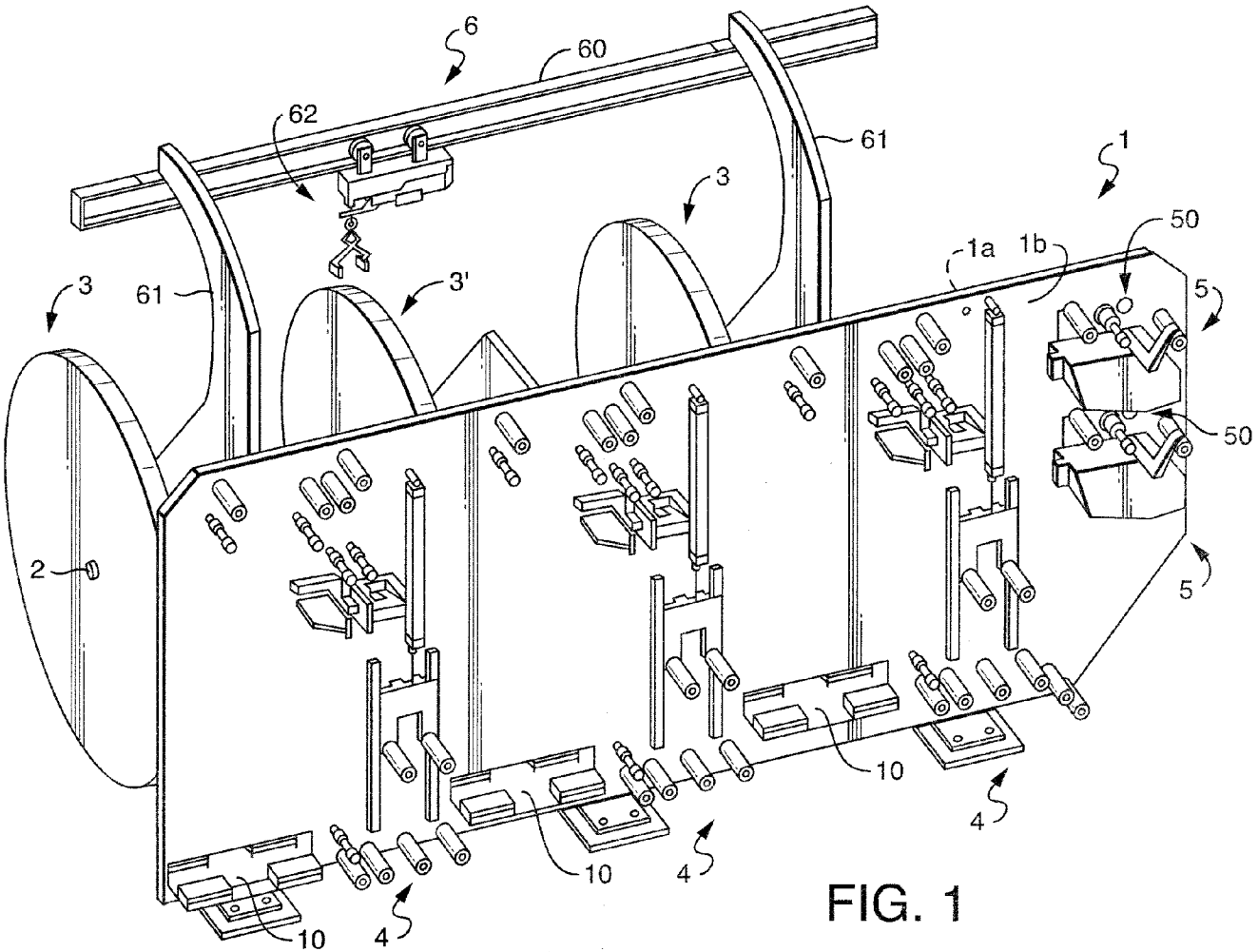
FIG. 1 is a schematic view in perspective of an apparatus according to the invention.

Referring to the drawings in particular, FIG. 1 is an apparatus according to the invention comprising a plan structure (1) having a development mostly longitudinal and which exhibits two opposite surfaces (1*a*, 1*b*). In correspondence of the first surface (1*a*), the structure (1) supports pairs of rotating shafts or axes (2, 2') horizontally oriented parallel to the same surface (1*a*).

Each of the shafts (2, 2') is intended to support a corresponding reel (3, 3') from which a web (N1, N2, N3; N1', N2', N3') of paper material or the like can unwind to supply a tube-making machine (T).

Because of the disposition of the axes for supporting the reels (3, 3'), these result parallel to each other, disposed vertically and oriented orthogonal to surface (1*a*) of structure (1). The axes (2, 2') of each pair of reels (3, 3') are coaxial and independent from each other, so that the rotation of a shaft (2, 2')—that is, of a reel (3, 3')—does not imply automatically the rotation of the other shaft (2, 2') of the pair—that is, of the other reel (3', 3).

The tube-forming machine (T) may be of a type known to those skilled in the art and, therefore, will not be described in further details.

The structure (1) is provided, in correspondence of its lower base, with a plurality of slits or windows (10) through which the webs unwinding from reels (3, 3') can pass from the side of the first surface (10) to the side of the second surface (1*b*).

On the side of the second structure (1*b*), the structure (1) supports a plurality of rollers (4) for guiding and tensioning the webs (N1, N2, N3) fed to the tube-forming machine (T).

In correspondence of the terminal side of structure 1 that is, on the exit side of webs fed to the tube-forming machine, the structure (1) has a plurality of tanks (5) holding liquid glue to be used for gluing the ventral (facing downwards) part of all the webs, with the exception of the one intended to make direct contact with the spindle of the tube-forming machine. In practice, if "n" indicates the number of webs, the number of tanks (5) will be "n−1".

The webs to be glued transit above the tanks (5), in correspondence of which there are provided suitable rollers and gluing means (50). The rollers are associated with relevant actuators (51) engaged with the surface (1*a*) of structure (1) and by means of which the webs (N2; N3) can be moved close to or away from the respective glue-feeding means. The web intended to make direct contact with the spindle of the tube-forming machine being indicated by (N1).

Figure 3:
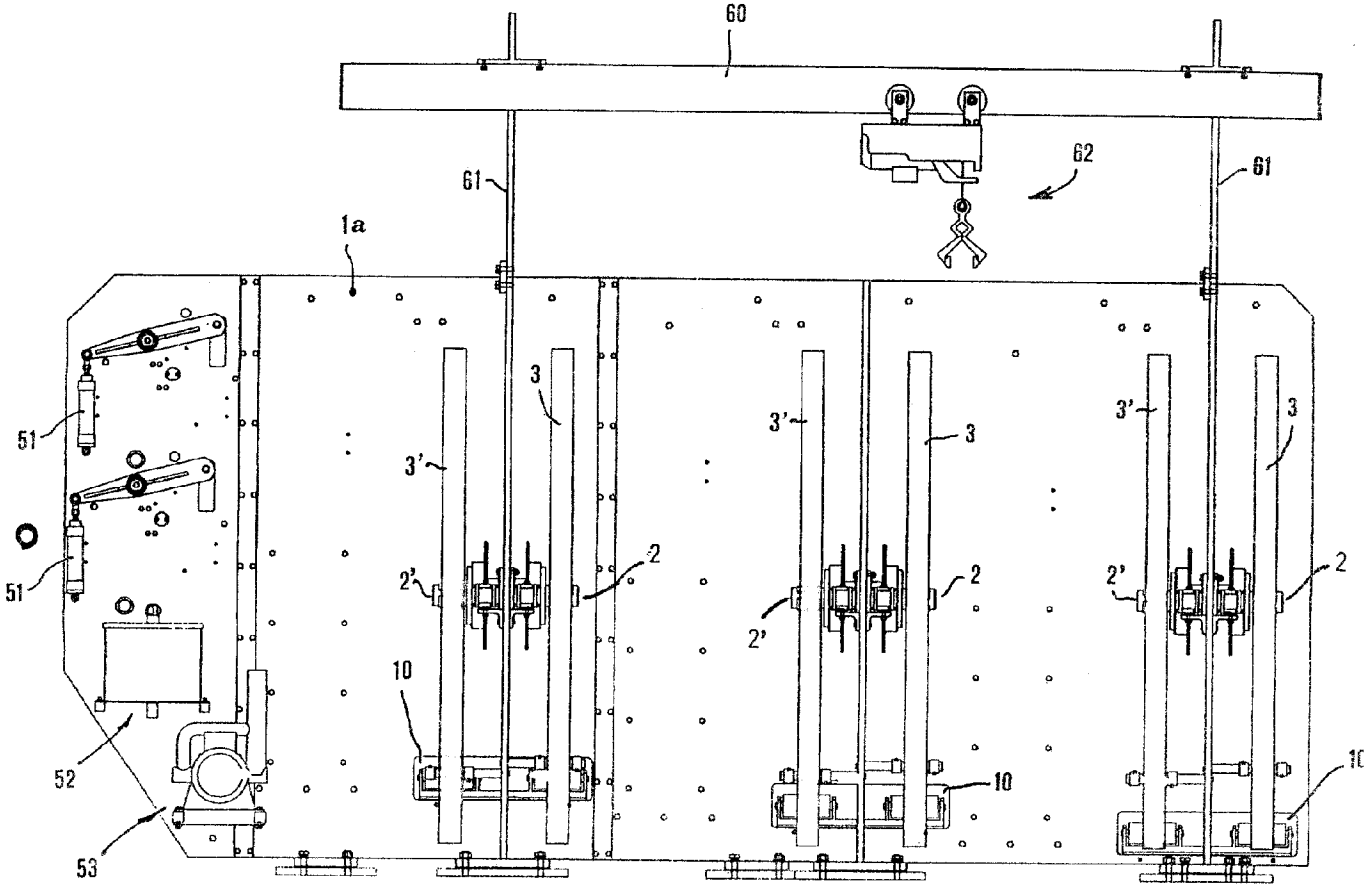
FIG. 3 is a rear view of the apparatus of FIG. 2.

FIG. 3 shows a reservoir (52) and a pump (53) for feeding glue to the tank (5). This web-gluing system is known per se to those skilled in the art.

Figure 2:
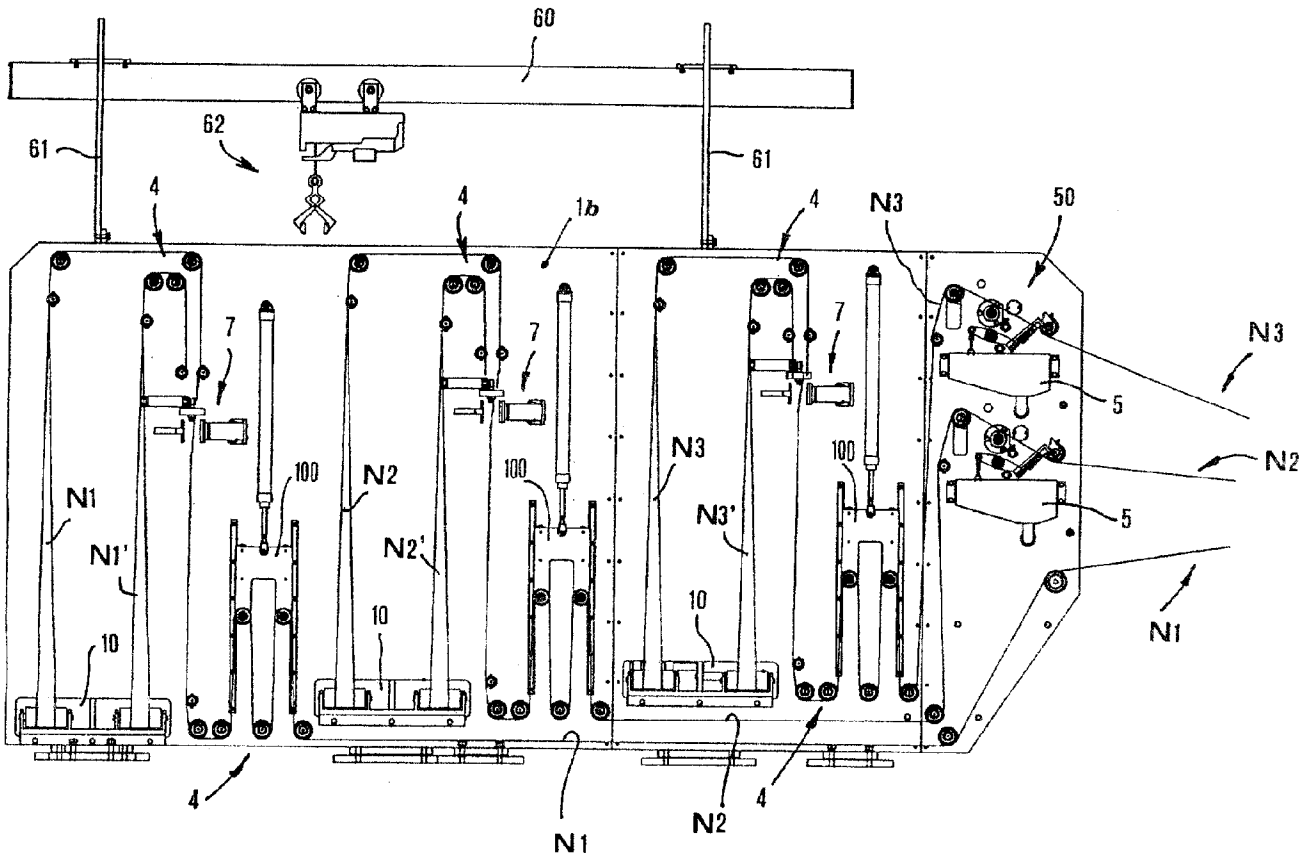
FIG. 2 is a front view of an apparatus according to the invention.
Figure 4:
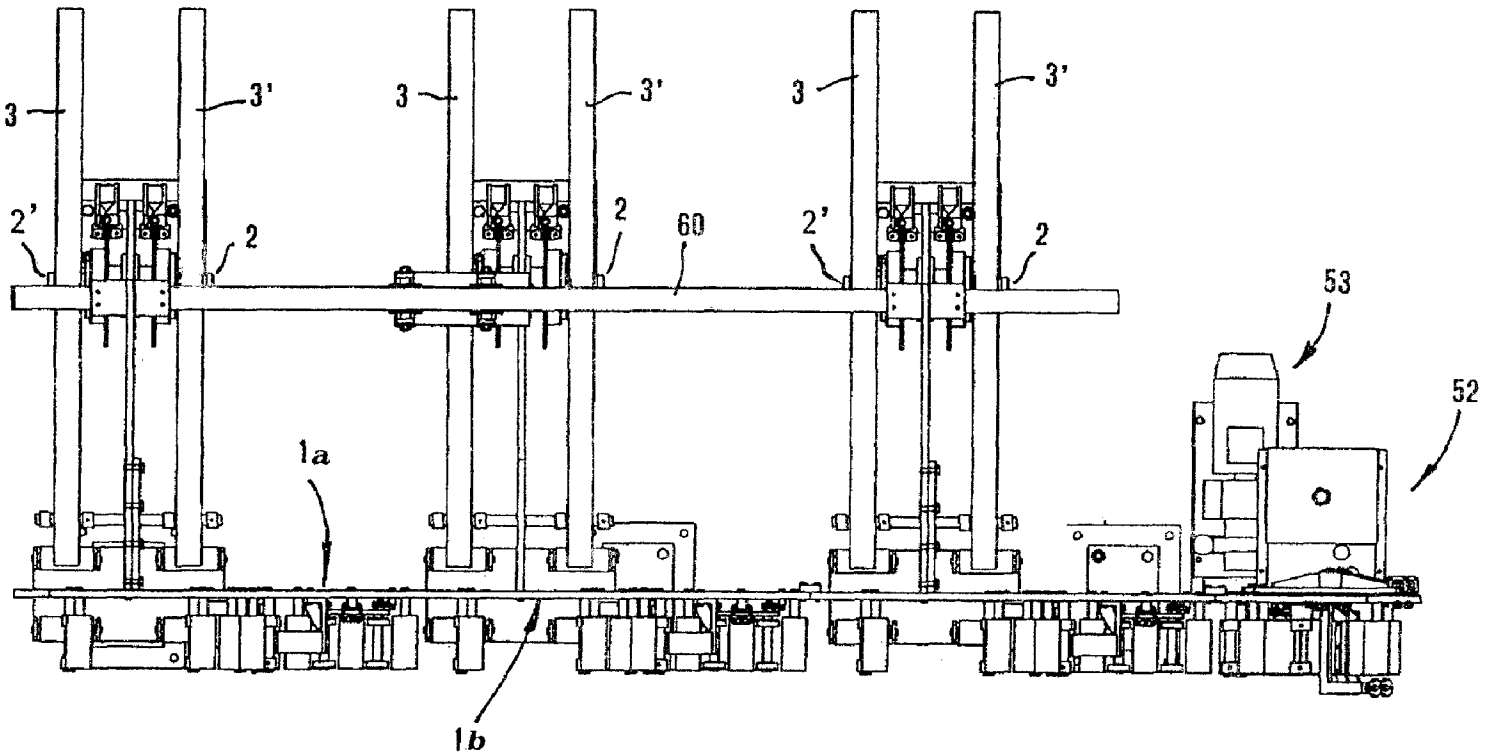
FIG. 4 is a plan view of the apparatus shown in FIGS. 2 and 3.
Figure 5:
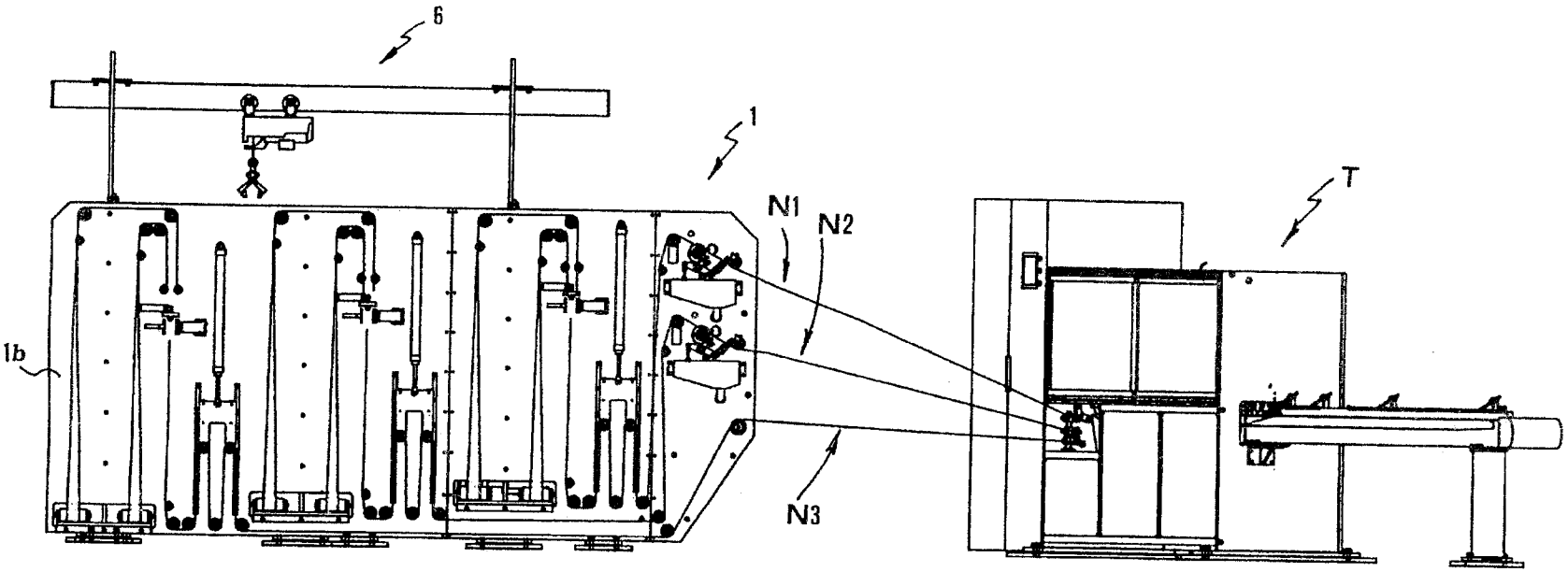
FIG. 5 shows schematically the combination of an apparatus according to the invention with a tube-forming machine (T)

As illustrated in FIGS. 2 and 4, the webs moving towards the tube-forming machine run parallel and superimposed along the second surface (1*b*) of the structure (1) and up to the tubeforming machine (without engaging fan-like trajectories as it occurs, instead, with the conventional devices), which allows exploiting more effectively the available spaces and orienting the structure more conveniently with respect to the tube-forming machine.

Moreover, the shape of the structure (1) allows utilizing an auxiliary structure (6) mounted on that side in correspondence of which there are provided the shafts (2, 2') for reels (3, 3') and comprising a horizontal crosspiece (60) mounted, at a preset level from the ground, onto more supports (61) and intended to act as a guide/support for a motor-driven elevator (62) which, in turn, is mounted for sliding on the same crosspiece (61). The elevator (62) can be suitably used (operated by a remote control not shown in the drawings but known per se) to lift the reels (3, 3') from the ground and keeping them suspended upon the positioning thereof on axes (2, 2'). Associated with the structure (1) are automatic means for unreeling the webs without interrupting the relevant flow toward the tube-forming machine (T) when one of the reels (3, 3') runs out of paper material.

Figure 6:
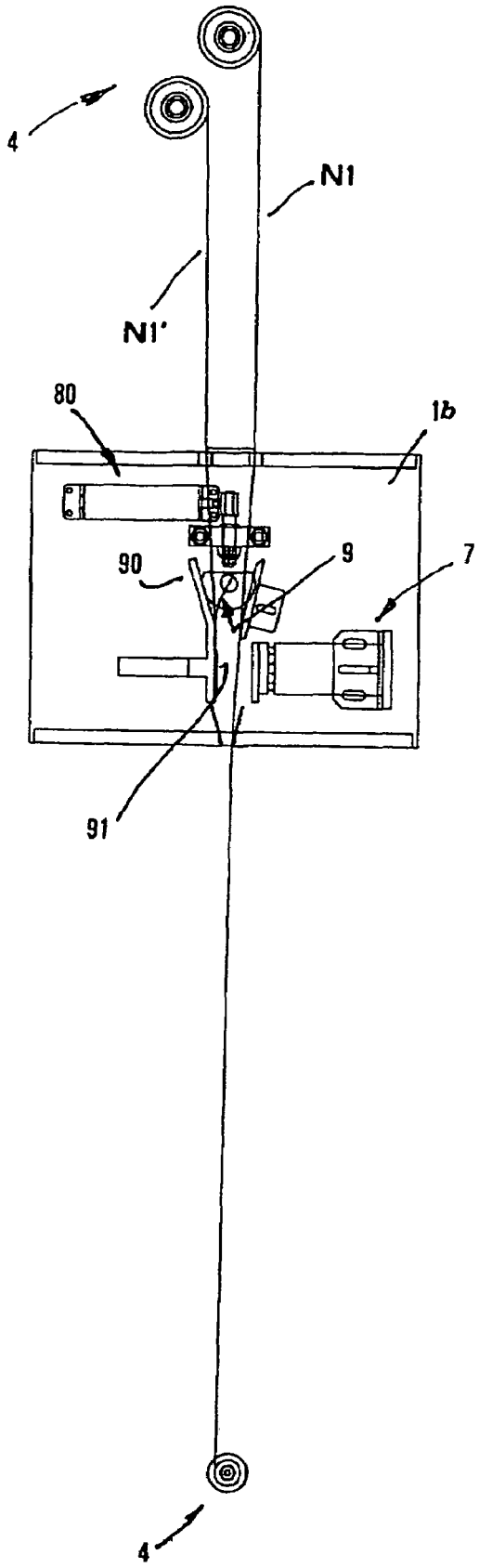
FIG. 6 is a schematic view of an automatic device for cuting and gluing the webs.
Figure 7:
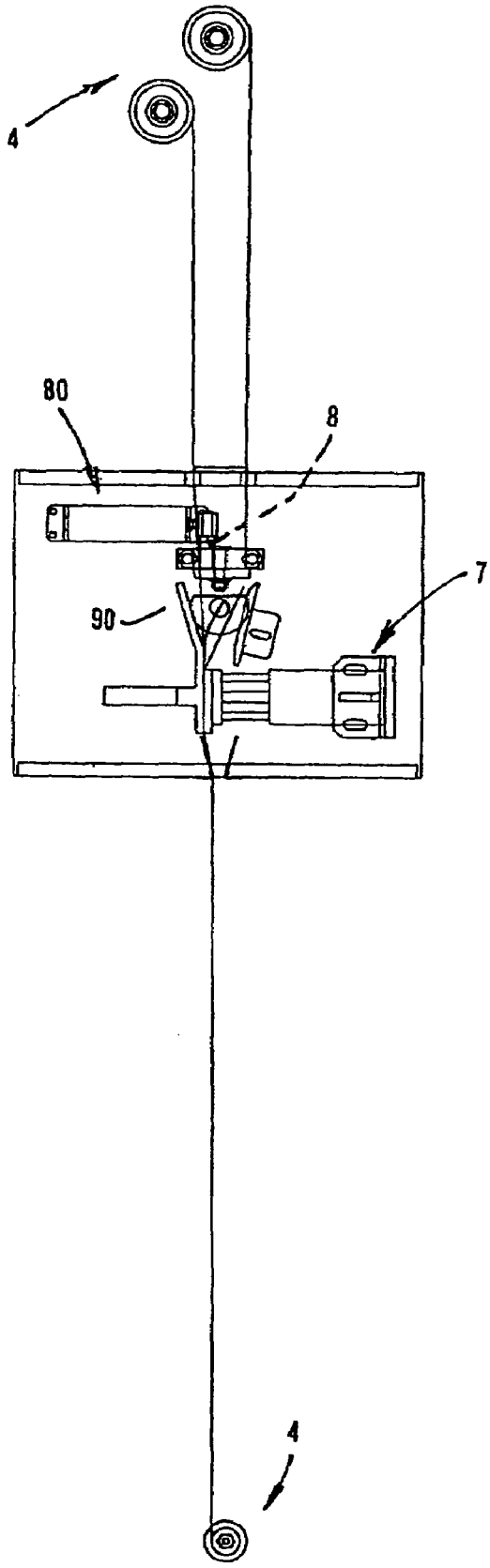
FIG. 7 is another schematic view of the automatic device for cutting and gluing the webs.
Figure 8:
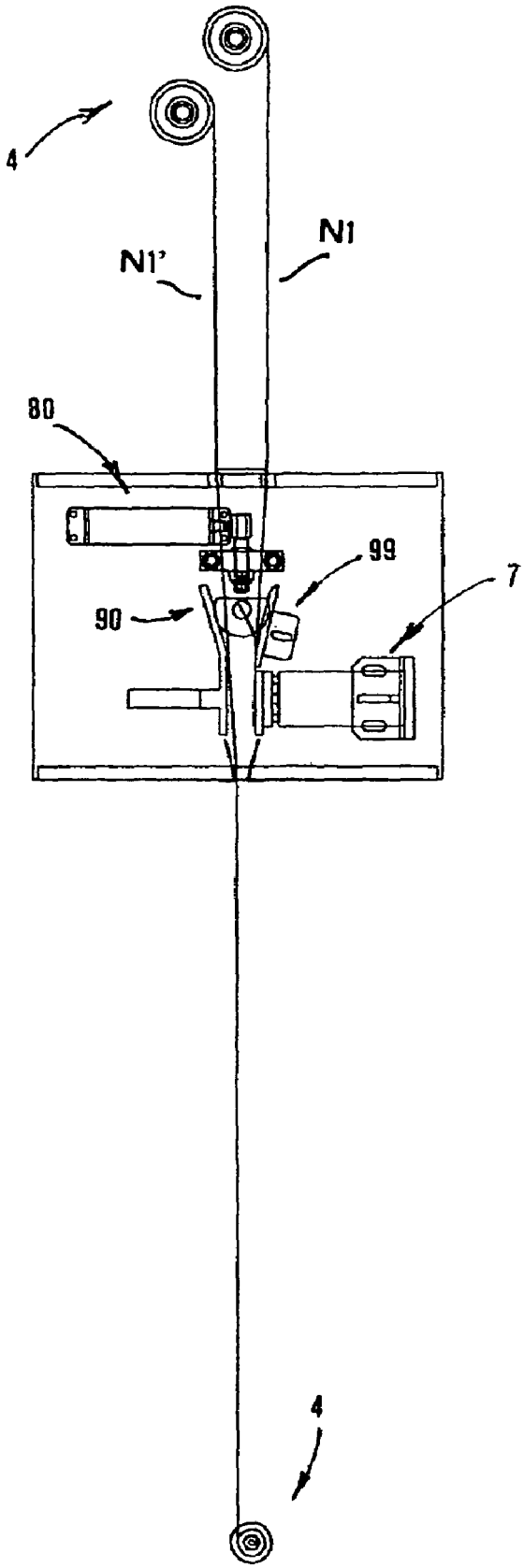
FIG. 8 is another schematic view of the automatic device for cutting and gluing the webs.
Figure 9:
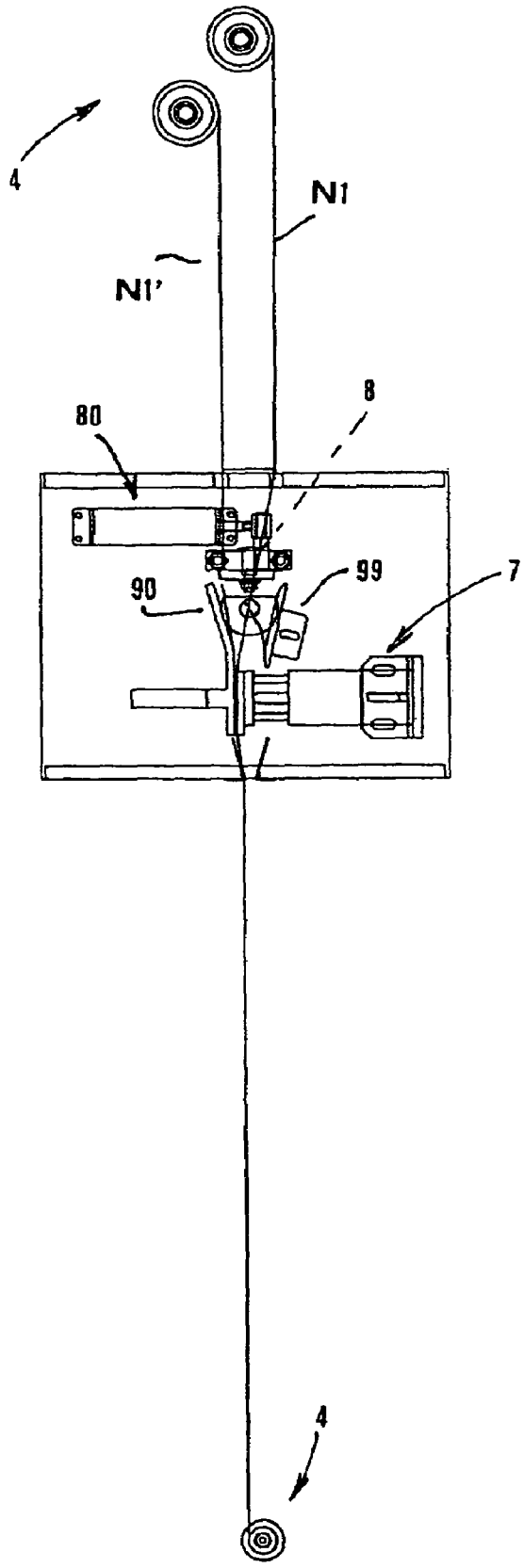
FIG. 9 is another schematic view of the automatic device for cutting and gluing the webs.

Shown in the illustrative diagrams of FIGS. 2, 5, 6, 7, 8 and is an automatic device for cutting and gluing the webs in a manner so-called "in full flight", which actually allows feeding the webs with continuity without interrupting the flow thereof toward the tube-forming machine (T) when one of the two reels of each module runs out of paper material. Such apparatus, being provided on each module of the structure, that is, for each pair of reels (3, 3') comprises, located under two web-guiding rollers (4), an operating unit with a presser cylinder (7) orthogonally oriented to the direction in which the webs unwind, a blade (8) associated with a relevant actuator (80) for cutting the webs and located above the presser cylinder (7) and, intermediate between the presser cylinder (7) and the actuator (80) of blade (8), a flexible lamina (9) intended to maintain the head of the other web adherent upon a fixed guiding surface (90). When one reel (for example, the reel of web N1) is about to run out of material (which is sensed by a corresponding photocell located close to the same reel at a preset distance from the relevant axis 2 and supported by a fixed part of the structure), the presser (7) is automatically operated after a predetermined time. An operator will have glued beforehand a piece of both-sides-adhesive tape (91) on the head of a stand-by web (N1'), so that the actuation of the presser (7) causes the gluing of the reeling off web (N1) on the adhesive tape attached on the head of the stand-by web (N1'). In this regard, it should be noted that both webs (N1, N1') result between the surface (90) and the presser (7). Approximately at the same time, the actuator (80) is started for cutting the reeling off web (N1) and, thereafter, the presser (7) and actuator (80) are brought back in their initial conditions (as shown in FIG. 6). In this way, the flow of webs toward the tube-forming machine (T) never stops. When the web (N1') is fully reeled off, the same operation will be performed on the head of the successive stand-by web (N1) after attaching the adhesive tape (91) (and having provided, of course, for replacing the corresponding reel in the meantime), as illustrated in the schematic diagrams of FIGS. 8 and 9. In order to keep the web (N1) in stand-by condition, it can be used the same reed above described (9) which retains the head of web (N1) adherent to a fixed surface (99) located in front of the fixed surface (90).

Figure 10:
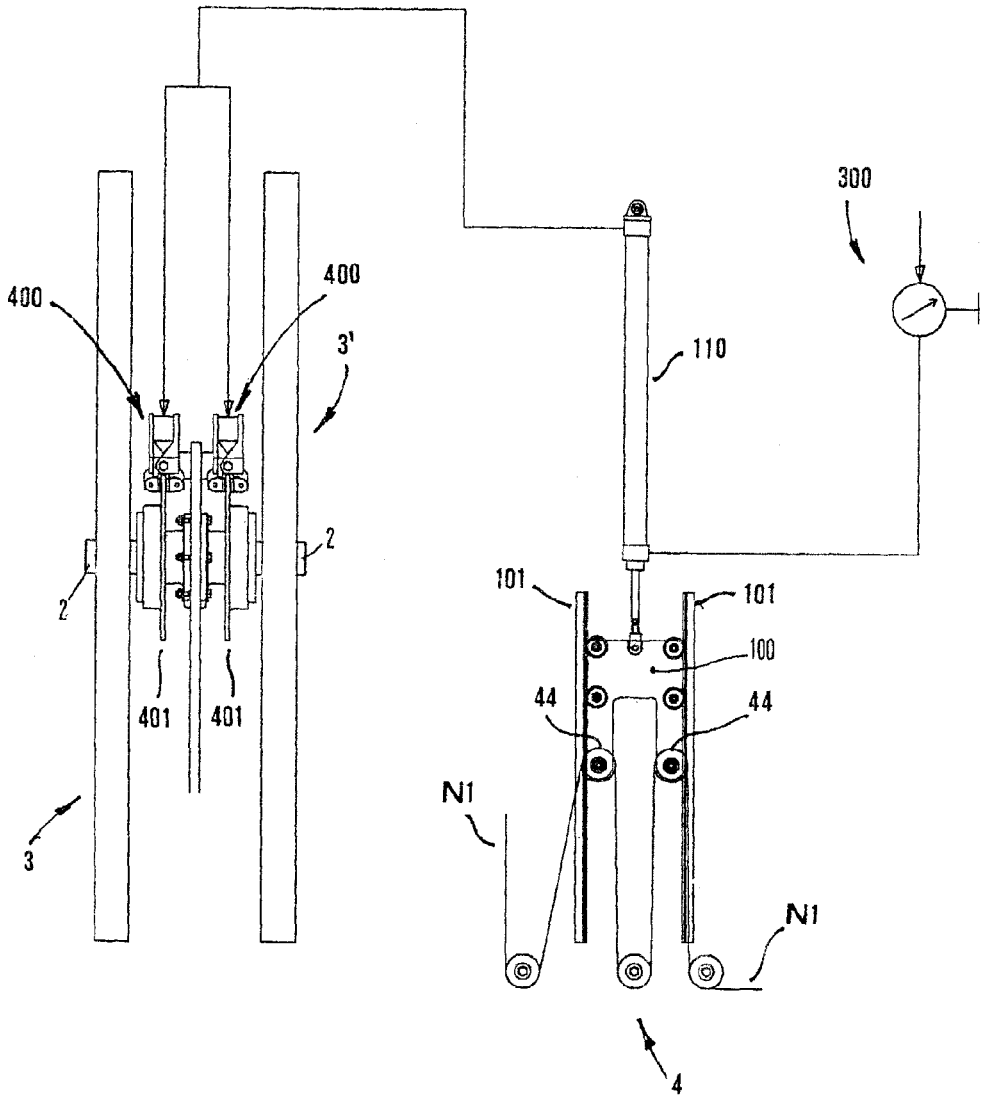
FIG. 10 is a front view of a device for controlling the tension of the webs.

A structure according to the invention allows also using, for each module, that is, for each of the webs fed to the tube-forming machine (T), a device for controlling the tension of the webs. Such device, according to the example illustrated in FIG. 10, comprises a plate (100) mounted on two vertical guiding rails (101) and provided with two rollers (44) for the guide of a corresponding web in cooperation with the other fixed rollers (4) of the system. The plate is engaged on top with the rod of a pneumatic cylinder (110) having dual (lower/upper) chamber, so that the position of the plate (100) corresponds to that of the rod of cylinder (110). The lower chamber of the cylinder (110) is supplied with compressed air via a controller (300) which allows adjusting the resistance to the lowering of the plate (100) engaged with the rod of cylinder (110). The upper chamber of the latter is pneumatically connected to two pneumatic grippers (400) each of which acts on a corresponding disc (401) keyed on the axis (2) of reels (3, 3') of the structure's module associated with the device.

During operation, the diameter of the reel (3, 3') becomes smaller and smaller and, since the tension applied on the respective web (N1) is constant and corresponds to the return action operated by the tube-forming machine (T), the plate (100) tends to come down by driving along with it the rod of cylinder (110) and, thereby, increasing the volume of the upper chamber of the latter. This brings about a reduction of the pressure exerted on the grippers (400) and, accordingly, a gradual reduction of the braking action applied on the discs (401) of axis (2). In this way, practically, the tension of the web is kept constant in the portion between the respective reel and the tube-forming machine also when the diameter of the reel becomes smaller and smaller.

Practically, (all) the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

While specific embodiments of the invention have been shown and described in detail to illustrate the application of the principles of the invention, it will be understood that the invention may be embodied otherwise without departing from such principles.

The invention claimed is:

1. Apparatus for feeding paper webs and the like, for producing cardboard tubes, the apparatus comprising: a plan modular structure with a development mostly longitudinal and exhibiting two opposite surfaces, one of said surfaces supporting pairs of shafts or axes horizontally oriented parallel to said one surface and located at a preset distance from the ground, each of said shafts or axes intended to support at least a reel from which a paper web unwinds, so that the output webs run parallel and superimposed to each other along the other surface of the structure, and in that it comprises automatic means, associated with said structure, for the cutting and mutual gluing of the webs which unwind from two different reels of a same pair of shafts.

2. Apparatus according to claim 1, wherein said structure has a plurality of slits or windows through which said webs can pass from the side of a surface to the side of the other surface.

3. Apparatus according to claim 1, further comprising means associated with said structure for guiding said webs.

4. Apparatus according to claim 1, further comprising means associated with said structure for the ventral gluing of a portion of said webs.

5. Apparatus according to claim 1, further comprising means for adjusting the tension of the webs which run along said surface opposite to the surface that supports said shafts.

* * * * *